US006652302B1

(12) United States Patent
Yeh

(10) Patent No.: US 6,652,302 B1
(45) Date of Patent: Nov. 25, 2003

(54) ELECTRICAL CONNECTOR WITH PIVOTABLE CONTACT

(75) Inventor: Ryan Yeh, Chino Hills, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/150,729

(22) Filed: May 17, 2002

(51) Int. Cl.[7] ..... H01R 29/00
(52) U.S. Cl. ..... 439/188; 439/11; 439/660
(58) Field of Search ..... 439/188, 11, 660

(56) References Cited

U.S. PATENT DOCUMENTS 5,885,090 A * 3/1999 Comstock et al. ..... 439/65
6,027,381 A * 2/2000 Gordon ..... 439/739
6,077,130 A * 6/2000 Hughes et al. ..... 439/862
6,113,440 A * 9/2000 Fijten et al. ..... 439/862

* cited by examiner

*Primary Examiner*—Gary Paumen
(74) *Attorney, Agent, or Firm*—Wei Te Chung

(57) ABSTRACT

An electrical connector (1) for connecting a battery (6) with a printed circuit board includes an insulative housing (10) defining a plurality of passageways (11), a pivot portion (30) mounted in an upper portion of the housing, a holding portion (20) mounted in a lower portion of the housing, first contacts (40) received in the passageways and rotatablely engaging with the pivot portion, and second contacts (50) each having a connecting portion (52) insert molded in the holding portion. The first contacts separate from the second contacts when the connector is not mated with the battery, and are rotated to engage with the second contacts when the battery is brought to mate with the connector by engaging with the first contacts.

1 Claim, 4 Drawing Sheets

ELECTRICAL CONNECTOR WITH PIVOTABLE CONTACT

CROSS-REFERENCE TO RELATED APPLICATION

This application is a co-pending application of patent applications with Ser. Nos. 10/150,846 and 10/150,855, respectively entitled "BATTERY CONNECTOR WITH DUAL COMPRESSION TERMINALS", and "BATTERY CONNECTOR", invented by the same inventor, filed on the same date, and assigned to the same assignee of the present invention.

BACKGROUND OF THE INVENTION

1. Field of the Invention

The present invention relates to an electrical connector, and more particularly to a battery connector having pivotable dual compression contacts for reliably mating with a battery and easily mounting to a printed circuit board.

2. Description of the Related Art

A battery connector is used for transmitting power from a battery to an electronic device. Such a battery connector is, for example, disclosed in U.S. Pat. Nos. 6,027,381 and 6,077,130. The connector generally has an insulative housing and resilient contacts arranged in the housing. Each of the resilient contacts has a mating portion for contacting with the battery and a mounting portion for mounting onto a printed circuit board (PCB). The mounting portion is soldered to a predetermined position on the PCB by surface mount technology (SMT), which results in complex process and increased manufacture cost. Similar battery connectors are also disclosed in U.S. Pat. Nos. 5,885,090 and 6,113,440.

The connectors disclosed in U.S. Pat. Nos. 5,885,090 and 6,113,440 each have contact which due to their configuration, cannot have sufficiently large resiliency to ensure a reliable connection thereof with a mating battery worse, after a long time of use, the contacts may fatigue to entirely load intended their function, which may result in loose and unreliable connections between the contacts and the battery due to insufficient resiliency and metal fatigue of the contacts after a long term of use.

Furthermore, the contacts of U.S. Pat. Nos. 5,885,090 and 6,113,440 are securely fixed in housings thereof, whereby mating portions of contacts thereof only can move slightly within a limited range, which limits a loading direction of a mating battery to either connector of the two patents.

Hence, a battery connector with improved contacts is required to overcome the disadvantages of the prior art device as disclosed above.

BRIEF SUMMARY OF THE INVENTION

One object of the present invention is to provide a battery connector having pivotable contacts to ensure a reliable connection with a mating battery.

A second object of the present invention is to provide a battery connector allowing convenient loading of a battery in both vertical and horizontal directions.

A third object of the present invention is to provide a battery connector which can be mounted on a printed circuit board (PCB) without soldering.

An electrical connector according to the present invention includes an insulative housing defining a plurality of passageways, a pivot portion mounted in an upper portion of the housing, a holding portion mounted in a lower portion of the housing, first contacts received in the passageways and rotatablely engaging with the pivot portion, and second contacts each having a connecting portion insert molded in the holding portion.

The first contacts separate from the second contacts when the connector is not mated with the battery, and are rotated to engage with the second contacts when the battery is brought to mate with the connector by engaging with the first contacts.

Other objects, advantages and novel features of the invention will become more apparent from the following detailed description when taken in conjunction with the accompanying drawings.

DETAILED DESCRIPTION OF THE INVENTION

Figure 1:
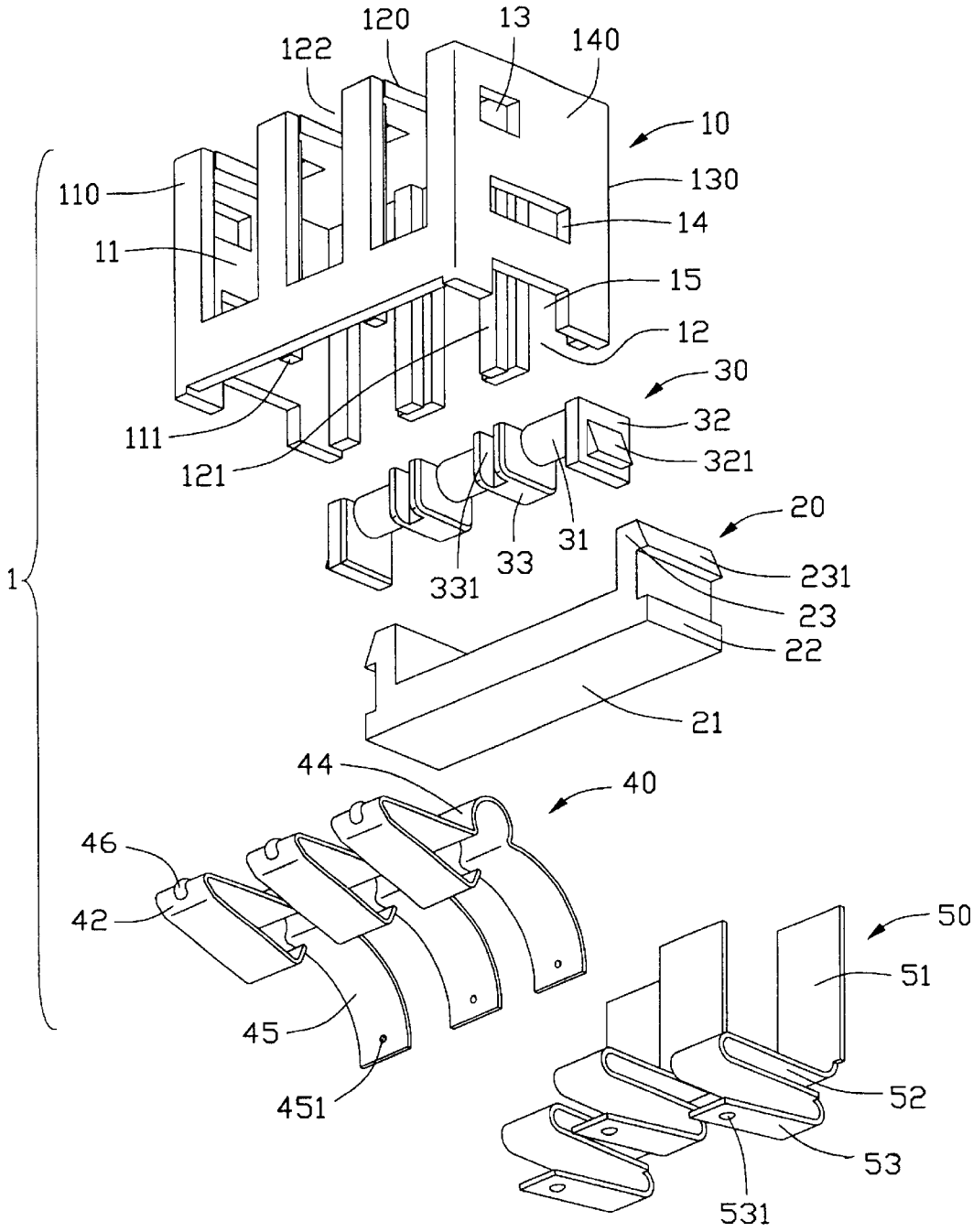
FIG. 1 is an exploded perspective view of a battery connector according to the present invention.

Referring to the drawings and particularly to FIG. 1, a battery connector 1 in accordance with the present invention comprises a dielectric housing 10, a dielectric holding portion 20, a dielectric pivot portion 30, three first contacts 40 and three second contacts 50.

The dielectric housing 10 comprises a front wall 110, a top wall 120, a rear wall 130 and a pair of side walls 140 together defining a receiving chamber therebetween (not labeled). Each side wall 140 defines a cutout 15 in a bottom edge thereof, a first opening 13 in an upper portion thereof and a second opening 14 between the first opening 13 and the cutout 15. Three parallel passageways 11 are defined through the front wall 110. The top wall 120 defines three horizontal slots 122 in communication with the passageways 11. Three vertical slots 12 are defined in the rear wall 130, each aligned with and communicating with a corresponding passageway 11. A vertical first bar 111 is formed on an inner surface of the front wall 110 between every two adjacent passageways 110. A vertical second bar 121 is formed on an inner surface of the rear wall 130 between every two adjacent slots 12.

The holding portion 20 includes a transverse body portion 21 having two end portions 22, and a pair of engaging portions 23 protruding upwardly from the two end portions 22 respectively. A hook portion 231 is formed on an upper portion of each engaging portion 23. The two hook portions 231 extend away from each other.

The pivot portion 30 includes a transverse pivot 31, a pair of engaging blocks 32 respectively formed on two lateral ends of the pivot 31, and a pair of holding blocks 33 formed on the pivot 31 and dividing the pivot 31 into three equal parts. A wedge-shaped locking portion 321 is formed on an outer side of each engaging block 32. A holding groove 331 is defined in a front side of each holding block 33.

Each first contact 40, formed by stamping a sheet metal, includes a curved first contacting portion 45, a substantially horizontal V-shaped mating portion 42, and a camber portion 44 connecting an upper end of the first contacting portion 45 with a rear end of the mating portion 42. A first convex portion 451 is formed on a rear surface of each first contacting portion 45. A rib 46 protrudes longitudinally from an upper surface of each mating portion 42.

Each second contact 50, also formed by stamping a sheet metal, includes a vertical rectangular second contacting portion 51, an inclined mounting portion 53, and a horizontal U-shaped connecting portion 52 connecting a lower end of the second contacting portion 51 with an upper end of the mounting portion 53. A second convex portion 531 is formed on a bottom surface of each mounting portion 53.

Figure 2:
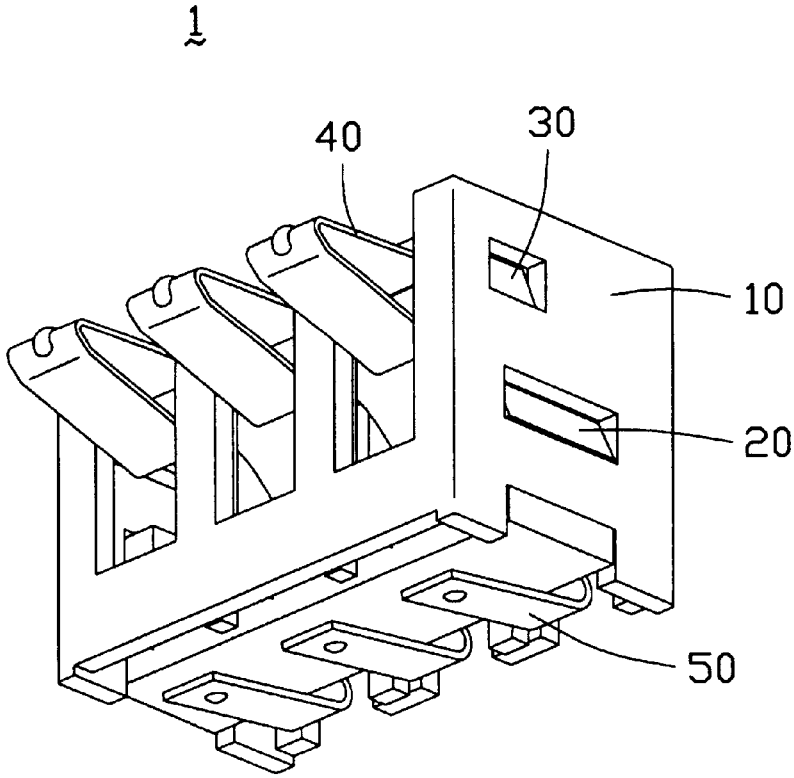
FIG. 2 is an assembled view of FIG. 1.
Figure 3:
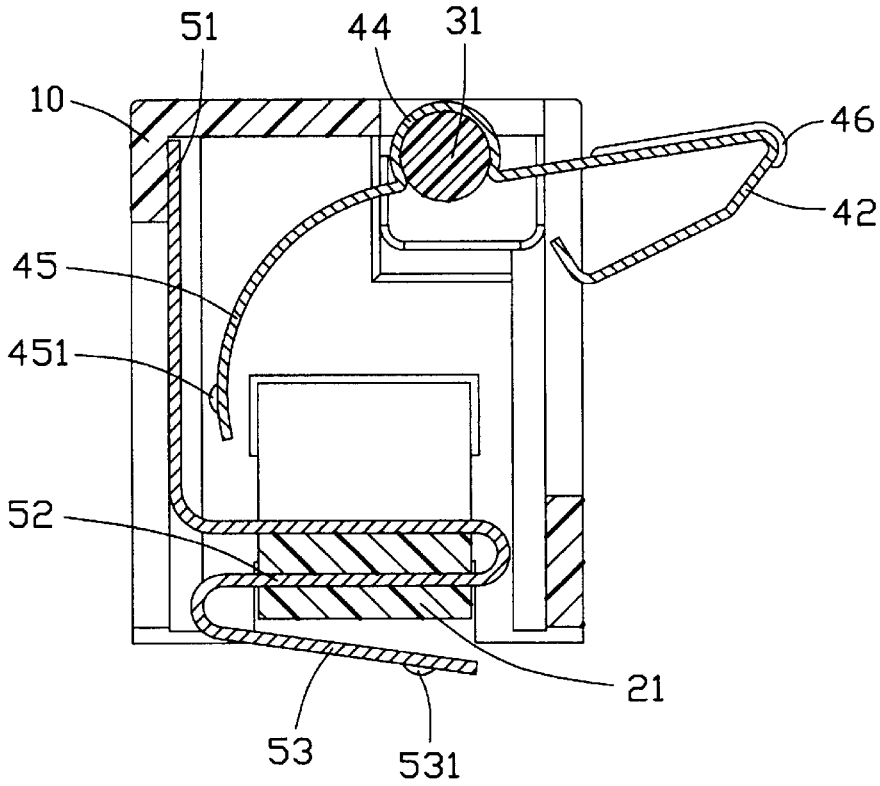
FIG. 3 is a cross-sectional view of the connector of FIG. 2.

Referring to FIGS. 2 and 3, in assembly, the first contacts 40 are respectively inserted into corresponding passageways 11 of the housing 10 with the mating portions 42 thereof extending out of the front wall 110. The pivot portion 30 is inserted into the housing 10 with the locking portions 321 locked in the first openings 13 in the side walls 130 and with the holding grooves 331 engaging with the first bars 111. The first contacts 40 are held on the pivot portion 30 by the camber portions 44 rotatablely engaging with the pivot 31 of the pivot portion 30. Each camber portion 44 is positioned between two holding blocks 33 or a holding block 33 and an engaging block 32.

The connecting portions 52 of the second contacts 50 are insert molded into the body portion 21 of the holding portion 20. It should be noted that, for a clear view, the second contacts 50 are separated from the holding portion 20 in FIG. 1. The holding portion 20 is inserted into the housing 10 together with the second contacts 50. The hook portions 231 of the holding portion 20 engage with the second openings 14 of the housing 10. The end portions 22 of the body portion 21 engage with the cutouts 15 of the housing 10. The width of the second contacting portion 51 of each second contact 50 is wider than that of each slot 12. The second contacting portions 51 are attached to the inner surface of the rear wall 130 and separated by the second bars 121. The mounting portion 53 downwardly extends out of the housing 10 to contact with a printed circuit board (not shown).

Particularly referring to FIG. 3, before the battery connector 1 engages with a mating portion 61 of a battery 6 (shown in FIG. 4), the first contacting portions 45 of the first contacts 40 are not engaged with the second contacting portions 51 of the second contacts 50.

Figure 4:
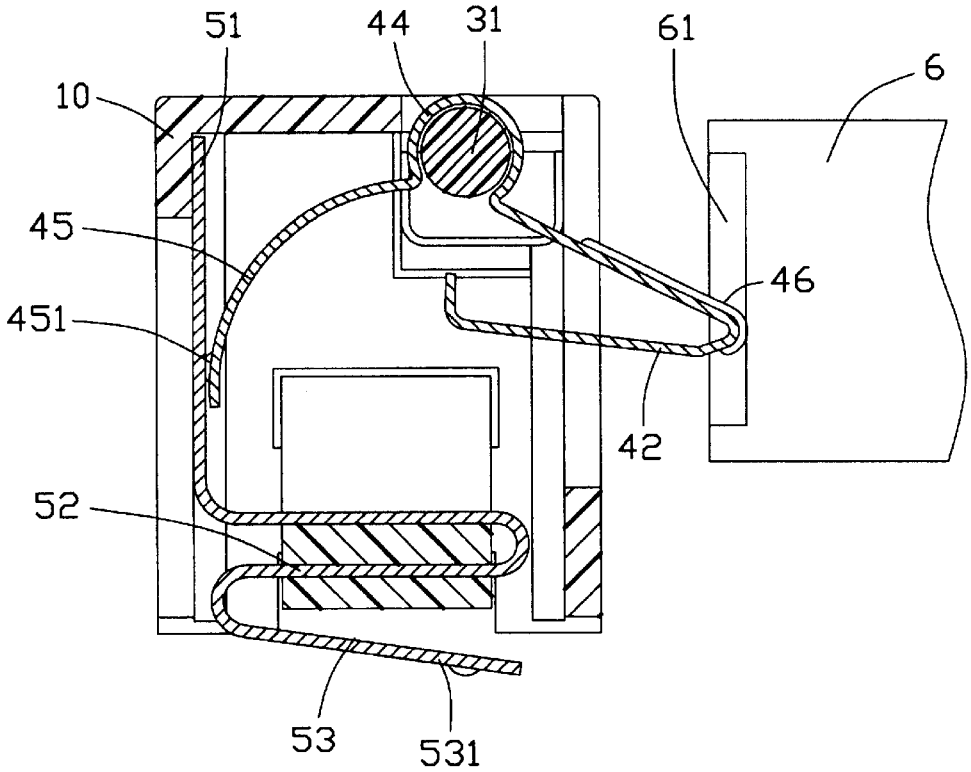
FIG. 4 is a cross-sectional view of the connector of FIG. 2 when mating with a battery.

Reference is now directed to FIG. 4. When the mating portion 61 of the battery 6 engages with the first contacts 40 of the battery connector 1, the mating portions 42 of the first contacts 40 are driven to rotate about the pivot 31 of the pivot portion 30, and the first contacting portions 45 are moved to engage with the second contacting portions 51 of the second contacts 50 via the first convex portions 451 on the first contacting portions 45.

By such a design, the connection between the battery connector 1 and the battery 6 is reliable and versatile regarding the mounting direction of the battery 6. Since the first contacts 40 and the second contacts 50 are separated from each other and pivotably engaged, sufficient resiliency is provided to the first contacts 40 to engage with the battery 6. Furthermore, the first contacts 40 rotatablely mounted on the pivot portion 30 are movable within a wide range, which allows convenient loading of the battery 6 in both vertical and horizontal directions to engage with the first contacts 40. The connection between the battery connector 1 and the printed circuit board is solderless and reliable due to the configuration of the mounting portions 53 of the second contacts 50 of the battery connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connecting a battery with a printed circuit board, comprising:

an insulative housing defining a passageway therein;

a pivot portion disposed in the housing;

a holding portion disposed in the housing;

a conductive first contact received in the passageway and rotatablely engaging with the pivot portion, the first contact having a mating portion for contacting with the battery; and a conductive second contact having a resilient mounting portion for connecting with the printed circuit board and a connecting portion retained in the holding portion; wherein the first contact is electrically connected with the second contact upon engaging with the battery;

wherein the first contact comprises a camber portion engaging with the pivot portion and a curved first contacting portion for connecting with the second contact, the camber portion connecting the mating portion with the first contacting portion;

wherein the second contact comprises a vertical second contacting portion extending upwardly from the connecting portion thereof to connect with the first contacting portion of the first contact;

wherein the connecting portion of the second contact has a U-shaped configuration comprising an upper end and a lower end, the second contacting portion of the second contact extends from the upper end, and the mounting portion of the second contact extends from the lower end;

wherein the connecting portion of the second contact is insert molded with the holding portion;

wherein the first contacting portion of the first contact comprises a convex portion to engage with the second contacting portion of the second contact;

wherein the housing defines a pair of first openings in an upper portion thereof, and the pivot portion comprises a pair of locking portions engaging with the first openings;

wherein the housing defines a pair of second openings in a lower portion thereof, and the holding portion comprises a pair of hook portions engaging with the second openings;

wherein the housing has a front surface and a bottom surface, the mating portion of the first contact extends out of the front surface of the housing, and the mounting portion of the second contact extends out of the bottom surface of the housing.

* * * * *